US005227694A

United States Patent [19]

Wertman

[11] Patent Number: 5,227,694

[45] Date of Patent: Jul. 13, 1993

[54] COLLECTOR APPARATUS FOR AN ELECTRON BEAM

[75] Inventor: Richard C. Wertman, Allentown, Pa.

[73] Assignee: ITT Corporation, New York, N.Y.

[21] Appl. No.: 794,382

[22] Filed: Nov. 19, 1991

[51] Int. Cl.[5] ..... H01J 23/027

[52] U.S. Cl. ..... 315/5.38

[58] Field of Search ..... 315/5.38

[56] References Cited

U.S. PATENT DOCUMENTS 3,260,885 7/1966 Crapuchettes ..... 315/5.38
3,388,281 6/1968 Arnaud ..... 315/5.38 X
3,970,891 7/1976 Heynisch et al. ..... 315/5.38 X

FOREIGN PATENT DOCUMENTS 656127 4/1979 U.S.S.R. ..... 315/5.38

*Primary Examiner*—Robert J. Pascal

*Assistant Examiner*—Benny T. Lee

*Attorney, Agent, or Firm*—Arthur L. Plevy; Patrick M. Hogan

[57] ABSTRACT

An electron collector apparatus for a traveling-wave tube includes a ceramic housing having a cavity formed therein. The interior surfaces of the cavity are coated with at least one layer of an electrically conductive material that is adapted to be coupled to a bias source. An aperture is formed in the cavity through which an electron beam may enter the cavity. As the electron beam impinges upon the cavity walls, the cavity walls heat and conduct heat into the housing. The housing conducts the heat to its outermost surface where it can be dissipated. The outermost surface of the housing is covered with an electrically conductive material that acts both as a Faraday cage and a base onto which heat exchangers and other cooling devices can be affixed.

20 Claims, 2 Drawing Sheets

COLLECTOR APPARATUS FOR AN ELECTRON BEAM

FIELD OF THE INVENTION

The present invention relates to an anode electrode, or electron collector, for a traveling-wave tube (TWT) and, more particularly, to electron collectors having a reduced number of component parts while providing superior operating characteristics and greater reliability.

BACKGROUND OF THE INVENTION

Traveling-wave tube (TWT) electron collectors and similar anode electrode devices are in widespread use. All electron collectors, regardless of their design, serve essentially the same function. Electron collectors are positively charged to attract and dissipate the electron bombardment emitted from a cathode electrode. The absorption of the electron bombardment causes the electron collector to heat. Consequently, many electron collectors are attached to heat sinks, heat exchangers, or other cooling devices. If an electron collector becomes overheated, the electron collector will be unable to maintain its positive charge and will fail to act as an anode.

When devices such as TWTs are miniaturized to fit certain applications, the electron collectors are also miniaturized. With a miniaturized electron collector, there is not much room for heat sinks or heat exchangers. Consequently, to prevent overheating, the power dissipated by the TWT must be limited so as to not exceed the capacity of the electron collector. As such, it is the electron collector that often limits the capacity of a TWT in a high power, small space application.

A typical state of the art TWT electron collector is shown in FIG. 1, which depicts a collector from a Type F-2390 TWT, manufactured by ITT Corporation, the assignee herein. As will be discussed, the electron collector is constructed of several component parts that make it difficult and expensive to both manufacture and miniaturize.

It is therefore a primary objective of the present invention to provide a TWT electron collector that utilizes a reduced number of component parts, is easier to fabricate, is more reliable and operates at higher temperatures than conventional prior art electron collectors of a comparable size.

SUMMARY OF THE INVENTION

The present invention is a TWT electron collector assembly having a ceramic housing in which a cylindrical cavity is formed. The surfaces inside the cylindrical cavity are coated with at least one layer of an electrically conductive material. The layers of conductive material are adapted to be coupled to a source of a positive electrical bias; thus, the surfaces inside the cylindrical cavity are given a positive charge. An electron beam enters the cylindrical cavity and is absorbed by the positively charged surfaces of the cavity. As the electron beam impinges upon the cavity walls, heat is created and the temperature of the cavity walls rise. Heat is conducted from the surfaces of the cavity into the ceramic housing. The heat is then conducted through the ceramic housing and directed to the outer surface of the housing. The outer surface of the housing is coated with metal or another conductive material. The outer conductive layer acts both as a RF shielding means and an attachment base through which heat exchangers or similar heat dissipating devices may be attached.

By reducing the component parts of the electron collector, performance characteristics remain unchanged while weight, size and manufacturing cost are reduced. The reduced size allows for greater range of application and also leaves more space available for heat dissipating devices. Consequently, the electron collectors can dissipate larger amounts of heat, for a given size application, increasing the performance of the TWT on which the electron collector is attached.

BRIEF DESCRIPTION OF THE FIGURES

For a better understanding of the present invention, reference is made to the following description of an exemplary embodiment thereof, considered in conjunction with the accompanying drawings, in which.

DETAILED DESCRIPTION OF THE FIGURES

Although the present invention can be used in many different applications where an electron beam is collected within a vacuum tube, it is especially suitable for use in connection with traveling-wave tubes (TWTs). Accordingly, the present invention will be described in connection with a TWT.

Figure 1:
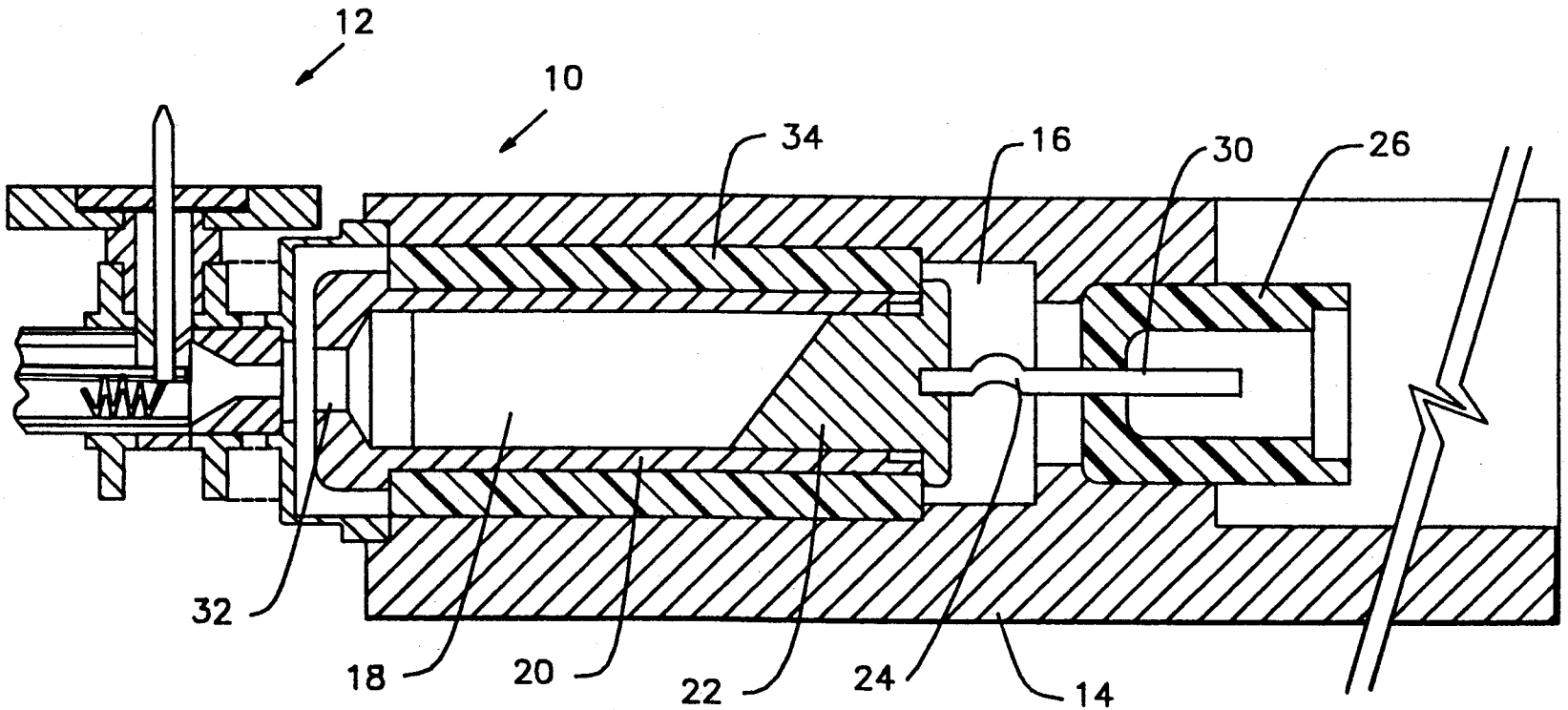
FIG. 1 PRIOR ART
FIG. 1 is a side cross-sectional view of a prior art traveling-wave tube collector shown in conjunction with the anode end of a traveling-wave tube.

Referring to FIG. 1, a prior art electron collector 10 is shown connected to TWT 12. The electron collector 10 is comprised of a metal housing 14 in which a cylindrical cavity 16 is formed. Within the cavity 16 is positioned a closed end bucket assembly 18 fabricated from a tubular jacket 20 having a solid base member 22 at one end. The tubular jacket 20 and base member 22 are conventionally manufactured from either oxygen-free copper or molybendenum and are brazed together to form the bucket assembly 18.

The solid base member 20 is affixed to an electrical connector 24, that couples the solid base member to a source providing a positive electrical bias (not shown). The electrical connector 24 is insulated from the metallic housing 14 by a ceramic feed through 26 made of an alumina ceramic. A tubing 30 of Kovar® is brazed onto the electrical connector 24 as it passes through the ceramic feed through 26. The tubing 30 prevents the electrical connector 24 from pitting and improves the high temperature characteristics of the connector 24.

The closed end bucket assembly 18 has a longitudinal axis that is aligned with the electron beam of the TWT 12, or a similar linear beam microwave tube. The electron beam enters the bucket assembly 18 through a centrally positioned end orifice 32. The bucket assembly 18 absorbs the electron beam bombardment, causing the bucket assembly 18 to heat. The tubular jacket 20 of the bucket assembly 18 is surrounded by a plurality of ceramic rods 34 which contact the surface of the tubular jacket 20. The ceramic rods 34 act as insulators, separating the positively charged bucket assembly 18 from the surrounding metal housing 14. The ceramic rods 34 also act to conduct heat away from the bucket assembly to the housing 14.

The metal housing 14 acts as a heat sink, absorbing heat conducted through the ceramic rods 34. The housing 14 may have cooling fins (not shown) or other heat exchangers connected to its outside surface, to help the housing dissipate the heat it has absorbed.

Figure 2:
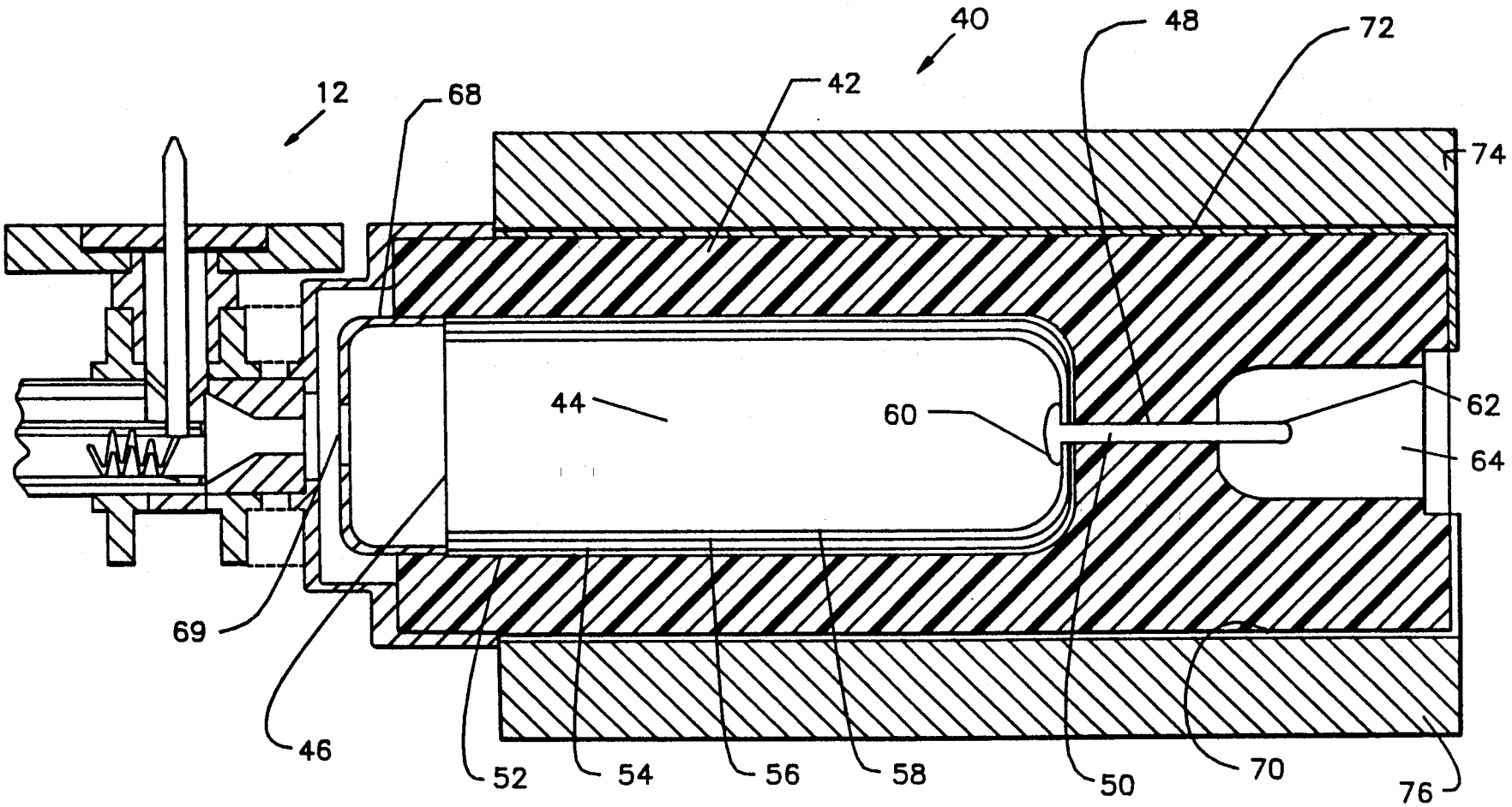
FIG. 2 is a side cross-sectional view of a traveling-wave tube electron collector constructed in accordance with one exemplary embodiment of the present invention, shown in conjunction with a traveling-wave tube.

Referring to FIG. 2, an exemplary embodiment of the present invention electron collector 40 is shown in combination with a TWT 12. The electron collector 40 has a substantially cylindrical housing 42 made of a ceramic material such as aluminum nitride or beryllium oxide. A cylindrical cavity 44 is formed within the housing 42 having a large open end 46. The opposing end of the cavity is mostly closed, except for the presence of a small aperture 48 through which an electrical pin connector 50 is positioned.

The inside wall 52 of the cylindrical cavity 44 is coated with an electrically conductive material. Preferably, the inside wall 52 of the cavity 44 is coated with a point five (0.5) to one (1.0) mil thick film of a molybendenum-manganese alloy 54. The molybendenum-manganese alloy 54 may be plated with subsequent layers of nickel 56 and copper 58. However, it should be understood that the cylindrical cavity 44 can be coated with any material, or combination of materials, that are both electrically and thermally conductive.

The electrical pin connector 50, positioned at the end of the cylindrical cavity 44, opposite its open end 46, is T-shaped with an enlarged head 60 and a cylindrical stem 62. When positioned within the aperture 48 at the end of the cavity 44, the enlarged head 60 seals the aperture 48 and couples the pin connector 50 to the conductive materials coating the inner wall 52 of the cavity 44.

The pin connector 50 is an integral high voltage connector made from an alloy that does not require a Kovar® encapsulation to efficiently conduct electricity without corrosion at high temperatures. The pin connector 50 is heat resistant and electrically conductive at temperatures of at least 150° C.

The cylindrical stem 62 of the pin connector 50 extends into an opening 64 formed into the housing 42. The opening 64 is formed to accept a connecting means (not shown) that operates to couple the pin 50 to a source of a positive electrical bias. The pin connector 50 connects the conductive materials coating the wall 52 of the cavity 44 to the source of the positive electrical bias. Consequently, the conductive materials coating the cavity 44 are also maintained at a positive charge, allowing the coated surface to absorb and disperse an electron beam bombardment.

The open end 46 of the cylindrical cavity 44 is covered by a metallic cap 68. The 68 has an aperture 69 formed through it that is aligned with the longitudinal axis of the cylindrical cavity 44 the linear pathway of the electron beam in the TWT. It should be understood that although a metallic cap 68 is shown, only the surface of the cap facing the cylindrical cavity 44 need be conductive. As such, the cap may be ceramic and have a conductive material coating similar to that of the cavity 44.

The outermost surface 70 of the ceramic housing 42 is covered in a layer of electrically and thermally conductive material 72 such as copper, molybendenum, or the like. The layer of conductive material 72 operates as an RF shield and further provides a metallic surface to which cooling fins 74, 76 or other heat exchangers or cooling means may be brazed or otherwise attached.

In operation, an electron beam from the TWT 12 enters the cylindrical cavity 44 through the cap aperture 69. The conductive material coating the cavity 44 maintains a positive charge and absorbs the electron beam bombardment. The metallic cap 68 prevents electrons from exiting the cylindrical cavity 44 through its open end 69. As the conductive materials coating the cylindrical cavity 44 absorbs the electron beam, the conductive materials begin to heat. The heat is conducted through the inner wall 52 of the cylindrical cavity 44 into the ceramic housing 42. The ceramic housing 42 conducts the heat to its outermost surface 70 which is coated with a layer of conductive material 72. The cooling fins 74, 76 absorb the heat from the housing 42, dissipating the heat to the surrounding environment.

Comparing the present invention electron collector 40 to the prior art electron collector of FIG. 1, it can be seen that the number of component parts creating the electron collector is greatly reduced. With the reduction in component parts comes a reduction in both materials and manufacturing cost. Additionally, the reduction in component parts results in an increase in performance reliability, since there are less parts and less manufacturing steps in which a defect can occur.

The present invention electron collector exhibits the performance characteristics of a traditional TWT electron collector, while being up to thirty-three percent smaller, twenty percent lighter, and eighty percent less expensive to manufacture. The decreased size and weight leave more available space for efficient heat exchangers. Consequently, the present invention electron collector enables operation at higher temperatures than traditional electron collectors of comparable size.

It should be understood that the embodiment described herein is merely exemplary and that a person skilled in the art may make variations and modifications without departing from the spirit and scope of the invention. More particularly, it should be understood that the composition of the referenced ceramics and metallic coating materials are interchangeable with numerous other materials that have similar electric and thermal conductive properties. All such variations and modifications are intended to be included within the scope of the invention as defined in the appended claims.

I claim:

1. A collector for receiving an electron beam from a cathode within an electron tube, comprising:

a unistructural dielectric housing;

a cavity within said housing having an open end through which said electron beam passes, said cavity being lined with at least one layer of conductive material; and an electrical connector extending through said housing from said cavity to a point exterior to said housing, said connector being electrically coupled to said at least one layer, thereby electrically coupling said at least one layer to said point exterior to said housing.

2. The collector according to claim 1, wherein said electrical connector extends through an orifice disposed in a distal surface of said cavity opposite said open end of said cavity.

3. The collector according to claim 2, wherein said electrical connector has an enlarged head that extends into said cavity, said enlarged head electrically contacting said at least one layer of conductive material which is positioned between said enlarged head and said distal surface.

4. The collector according to claim 1, wherein said at least one layer of conductive material includes a plurality of layers of conductive material.

5. The collector according to claim 4, wherein said plurality of conductive materials include a molybendenum-manganese alloy lining said housing within said cavity.

6. The collector according to claim 5, wherein said plurality of conductive materials includes a nickel layer lining said molybendenum-manganese alloy.

7. The collector according to claim 6, wherein said plurality of conductive materials includes a copper layer lining said nickel layer.

8. The collector according to claim 1, wherein said housing has an exterior surface coated with a layer of conductive material.

9. The collector according to claim 8, wherein a heat exchanging means is coupled to said conductive material on said exterior surface of said housing.

10. The collector according to claim 1, further including a conductive cap member positioned across said open end of said cavity, said conductive cap member including an aperture through which said electron beam passes said cap member electrically contacting said at least one layer of conductive material lining said cavity thus electrically coupling said cap member to said at least one layer of conductive material.

11. The collector according to claim 1, wherein said housing is a ceramic material.

12. A collector for receiving an electron beam from a cathode within an electron tube, comprising:

a single-piece dielectric housing having an internal cavity with one open end, said cavity being lined with at least one layer of conductive material;

an electrical connector extending through said housing from a terminal point external to said housing into said cavity, said connector contacting said at least one layer of conductive material in an electrically conductive manner, thereby electrically coupling said at least one conductive layer to said terminal point; and a conductive cap member positioned over said open end of said cavity, said conductive cap member including an aperture through which an electron beam passes into said cavity, wherein said cap member contacts said at least one layer of conductive material within said cavity, thus electrically coupling said cap member to said at least one layer of conductive materia.

13. The collector according to claim 12, wherein said electrical connector extends through an orifice disposed in a distal surface of said cavity, opposite said cap member.

14. The collector according to claim 13, wherein said electrical connector has an enlarged head with said cavity, said enlarged head electrically contacting said at least one layer of conductive material which is positioned between said enlarged head and said distal surface.

15. A collector for an electron tube, comprising:

a unistructural dielectric housing having an internal cavity with an open end and a closed end opposite said open end, said cavity being lined with multiple layers of conductive material;

an electrical connector extending through said housing from a terminal point external to said housing into said cavity, said connector electrically contracting at least one of said multiple layers of conductive material, thereby electrically coupling said multiple layers of conductive material to said terminal point.

16. The collector according to claim 15, wherein said electrical connector has an enlarged head overlaying said multiple layers of conductive material lining said cavity, said enlarged head electrically coupling said multiple layers of conductive material to said terminal point.

17. The collector according to claim 15, wherein said multiple layers of conductive material includes a molybendenum-manganese alloy layer lining said housing within said cavity.

18. The collector according to claim 17, wherein said plurality of conductive materials includes a nickel layer lining said molybendenum-manganese alloy layer.

19. The collector according to claim 18, wherein said plurality of conductive materials includes a copper layer lining said nickel plating layer.

20. The collector according to claim 15, wherein said housing has an exterior surface coated with a conductive material.

* * * * *